US009303459B2

(12) United States Patent
Jeffryes et al.

(10) Patent No.: US 9,303,459 B2
(45) Date of Patent: Apr. 5, 2016

(54) DRILLING APPARATUS

(75) Inventors: Benjamin Peter Jeffryes, Histon (GB); Ashley Bernard Johnson, Milton (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 1186 days.

(21) Appl. No.: 13/140,200

(22) PCT Filed: Dec. 19, 2008

(86) PCT No.: PCT/GB2008/004240

§ 371 (c)(1), (2), (4) Date: Nov. 26, 2011

(87) PCT Pub. No.: WO2010/070256

PCT Pub. Date: Jun. 24, 2010

(65) Prior Publication Data

US 2012/0055712 A1 Mar. 8, 2012

(51) Int. Cl.
*E21B 10/26* (2006.01)
*E21B 10/32* (2006.01)

(52) U.S. Cl.
CPC ..... *E21B 10/26* (2013.01); *E21B 10/32* (2013.01); *E21B 10/322* (2013.01)

(58) Field of Classification Search
USPC ..... 175/263, 327, 57, 296, 406, 202
See application file for complete search history.

(56) References Cited

U.S. PATENT DOCUMENTS

| | | | | |
|---|---|---|---|---|
| 2,085,997 | A * | 7/1937 | Phipps | 166/131 |
| 2,688,463 | A | 9/1954 | Bettes | |
| 3,231,031 | A | 1/1966 | Cleary | |
| 3,507,540 | A | 4/1970 | Silverman | |
| 3,851,719 | A | 12/1974 | Thompson et al. | |
| 5,180,020 | A | 1/1993 | Fuh et al. | |
| 5,207,282 | A | 5/1993 | Fuh et al. | |
| 5,402,856 | A | 4/1995 | Warren et al. | |
| 6,059,051 | A * | 5/2000 | Jewkes et al. | 175/76 |
| 6,419,019 | B1 | 7/2002 | Palmer et al. | |
| 7,316,277 | B2 * | 1/2008 | Jeffryes | 175/27 |
| 2003/0132032 | A1 | 7/2003 | Metcalfe et al. | |
| 2004/0250614 | A1 | 12/2004 | Ander | |

(Continued)

FOREIGN PATENT DOCUMENTS

| | | | |
|---|---|---|---|
| WO | 9928588 | A1 | 6/1999 |
| WO | 02097231 | A1 | 12/2002 |

(Continued)

OTHER PUBLICATIONS

International Search Report of PCT Application No. PCT/GB2008/004240 dated Sep. 7, 2009.

(Continued)

*Primary Examiner* — Jennifer H Gay
*Assistant Examiner* — Caroline Butcher
(74) *Attorney, Agent, or Firm* — Steven Gahlings

(57) ABSTRACT

An apparatus for drilling a wellbore (10) is disclosed, the apparatus comprising a lowermost pilot drill bit (16) having a diameter less than that of the diameter of wellbore (12) drilled by the apparatus, above which is a reamer, having an adjustable drill diameter from a first diameter less than that of the pilot drill to a second diameter greater than that of the pilot drill, above which is a body portion (24) having a lower diameter less than that of the pilot drill and an upper diameter greater than that of the pilot' drill but less than the second diameter of the reamer.

18 Claims, 5 Drawing Sheets

(56) References Cited

U.S. PATENT DOCUMENTS

| | | | |
|---|---|---|---|
| 2005/0230112 | A1 | 10/2005 | Reddy et al. |
| 2006/0070432 | A1 | 4/2006 | Ander |
| 2006/0122071 | A1 | 6/2006 | Reddy et al. |
| 2006/0213662 | A1 | 9/2006 | Creel et al. |
| 2007/0012447 | A1 | 1/2007 | Fang et al. |
| 2007/0017676 | A1 | 1/2007 | Reddy et al. |
| 2007/0017708 | A1 | 1/2007 | Radford et al. |
| 2007/0169937 | A1 | 7/2007 | Allin et al. |
| 2007/0173412 | A1 | 7/2007 | Allin et al. |
| 2007/0209796 | A1 | 9/2007 | Santra et al. |
| 2007/0287639 | A1 | 12/2007 | Reddy et al. |
| 2008/0000640 | A1 | 1/2008 | Santra et al. |
| 2008/0006404 | A1 | 1/2008 | Reddy et al. |
| 2009/0095474 | A1* | 4/2009 | Lesso et al. ..... 166/281 |

FOREIGN PATENT DOCUMENTS

| | | | |
|---|---|---|---|
| WO | 03078790 | A1 | 9/2003 |
| WO | 03102354 | A1 | 12/2003 |
| WO | 2007144719 | A2 | 12/2007 |
| WO | 2009123918 | A2 | 10/2009 |

OTHER PUBLICATIONS

Examination Report issued in GB1109802.7 on Jun. 25, 2012, 3 pages.

* cited by examiner

DRILLING APPARATUS

TECHNICAL FIELD

The invention relates to an apparatus for drilling a wellbore and to a method of operating the apparatus.

BACKGROUND

When drilling a fresh wellbore in the vicinity of underground hydrocarbon reservoirs, it is often desirable to fracture the walls of the drilled wellbore following drilling. This stimulates the productivity and flow of hydrocarbons into the wellbore.

Known methods of fracturing involve withdrawing the drill string from the wellbore followed by pressurising the downhole environment to overcome the fracture pressure of the surrounding formation, to produce fracturing. This is typically followed by further drilling followed by again withdrawing the drill string and pressurising the wellbore to cause fracture. This sequence of drilling followed by fracturing can be repeated several times as a wellbore is drilled.

SUMMARY

The invention relates to an apparatus for drilling a wellbore comprising a lowermost pilot drill bit having a diameter less than that of the diameter of wellbore drilled by the apparatus, above which is a reamer, having an adjustable drill diameter from a first diameter less than that of the pilot drill to a second diameter greater than that of the pilot drill, above which is a body portion having a lower diameter less than that of the pilot drill and an upper diameter greater than that of the pilot drill but less than the second diameter of the reamer.

In this way, the wellbore can be drilled with the pilot drill bit creating a pilot hole which is then increased in diameter by the reamer when in its second diameter position. When it is desired to fracture a drilled region the reamer is retracted to its first diameter while drilling with the pilot bit continues, the reamer passing into the drilled pilot hole, until the body portion blocks off the pilot hole by virtue of its variable diameter. At this point fracturing fluid is passed into the pilot hole, the pressure of which rises due to the fact that the pilot hole is hydraulically sealed by the body portion, eventually causing fractures in the walls of the pilot hole. The apparatus can then be withdrawn until the reamer is above the pilot hole, the reamer is then extended to its second diameter and drilling resumes until the apparatus reaches another region where fracturing is desired and the above steps are repeated.

Thus, the apparatus of the invention allows fracturing to be carried out while drilling, preventing the need to fully withdraw the drill string and reducing the time and significant cost associated with drilling.

Thus, in a second aspect, the invention relates to a method of drilling and fracturing a wellbore employing an apparatus according to the invention, wherein the pilot drill creates a pilot hole which is increased in diameter by the reamer in its second diameter position, retracting the reamer to its first diameter, continuing to drill the pilot hole until the body portion hydraulically seals the pilot hole by virtue of its variable diameter, passing fracturing fluid into the pilot hole sufficient to cause fracture of the walls of the pilot hole, withdrawing the apparatus until the reamer is above the pilot hole, extending the reamer to its second diameter and resuming drilling.

Typically the pilot drill bit will be connected to the body portion via the reamer and a shaft member with a diameter less than that of the pilot drill. This provides an annular space in the pilot hole into which the fracturing fluid passes during fracturing.

In an embodiment of the present invention, the shaft member has a variable length, e.g. extendable between a short length and a long length and biased to the long length such as a thruster, an axial spring or a shock sub. Thus, when downwards force is applied to the apparatus with the pilot drill in contact with the bottom of the hole, the apparatus moves downwards as the shaft member shortens, increasing the contact force between the pilot drill and the bottom hole.

The body portion may be tubular and have a circular cross section along its length. Thus the diameter of the circular cross section at the bottom is less than the diameter of the cross section at the upper diameter.

The change in diameter of the body portion with respect to height may be sudden or gradual and may involve more than one sudden contraction in diameter. However, preferably the diameter alters gradually with respect to height, i.e. producing a conical or frustro-conical body shape which may have a diameter which increases linearly with height or in a non-linear manner.

A gradual change in diameter provides a good seal at the top of the pilot hole as the body portion hydraulically seals it. As the body portion just touches the top of the pilot hole there will be an approximately circular contact region between the body portion and the pilot hole surface. This will generally not be sufficient contact area to resist the downwards force being applied to the apparatus and further downwards movement of the apparatus can be expected. This will result in the body portion deforming the top surface of the pilot hole to accommodate the increasing diameter until the rock formation resists any applied down force and further downwards movement of the apparatus ceases. Thus, the body portion plugs the pilot hole, hydraulically sealing it for fracturing.

In one aspect of the present invention, the body portion has a diameter above the upper diameter which is less than the upper diameter. In this embodiment the body portion will have a maximum diameter in the middle (the upper diameter). This aids removal of the apparatus from the drilled wellbore.

The reamer typically comprises retractable drilling elements which provide the adjustable drill diameter. The elements can be extended and/or retracted, for example, according to a command from the surface or as an automated response to a detected change in environmental properties, such as pressure drop across the bit.

In a typical drilling operation, drilling mud will pass down through the centre of the drill string and flow out at the pilot drill bit. The mud passes upwards outside the drill string and is collected at the surface. Once the reamer has been retracted to its first diameter, the pilot drill continues to drill down.

As the body portion begins to close onto the top of the pilot hole surface, the pressure in the annulus in the pilot hole will begin to rise as the exit area for the drilling mud becomes less and less. Too great a rise in pressure might result in premature fracturing of the walls of the pilot hole. This is generally undesirable as drilling muds are expensive and are desirably recovered, and more importantly a bespoke fracturing fluid is desirably used to fracture the pilot hole. Therefore, the flow of drilling mud is stopped if the pressure rises too high. The rise in pressure is therefore a reliable indicator that the body portion is about to contact the top of the pilot hole, as discussed above. Alternatively, a knowledge of the length of hole drilled may be used to determine when the body portion is about to contact the top of the pilot hole.

Therefore, before the body portion contacts the top of the pilot hole the drilling mud is preferably circulated out and replaced by a fluid suitable for fracturing. Such a fracturing fluid may desirably comprise proppant to prevent any formed fractures from collapsing and other chemical agents known to the person skilled in the art to be useful in a fracturing fluid.

To assist the replacement of drilling mud with fracturing fluid it may be necessary to lift the apparatus a short distance off bottom.

Once the body portion has hydraulically sealed the pilot hole, as described above, the fracturing fluid is pumped until its pressure causes the walls to fracture and fracturing fluid to enter them. Known fracturing procedures can then be employed and as soon as the formed fractures are completed and propped the apparatus can be raised until the reamer is above the pilot hole, the diameter of the reamer extended to its second diameter, drilling mud is restarted and drilling resumes.

In some aspects of the present invention, the wellbore may be sealed above the apparatus and pressurise to reduce the upwards force on the apparatus due to pressure difference. Care must be taken that this balancing pressure does not rise so high as to cause fracturing.

As drilling resumes, the pilot drill will not be in contact with the formation. Once the pilot drill makes contact either the apparatus can continue drilling until a new fracture is desired or the method of the invention can begin again.

In an embodiment of the present invention, the apparatus comprises at least one flow channel for directing upwards flowing fluid. Such a flow channel has its lowermost entry port above the reamer but below the region of the body portion which contacts the top of the pilot hole. The uppermost exit port being above the region of the body portion which contacts the top of the pilot hole, preferably at a portion above the maximum diameter of the body portion.

Such flow channels allow fluid to flow out of the pilot hole even when the body portion has hydraulically sealed it, preventing sudden rises in pressure as the body portion connects with the top of the pilot hole. Clearly such flow channels must be closeable, in order for pressure in the pilot hole to rise sufficient to cause fracturing, however this may be achieved independently of the hydraulic sealing of the pilot hole, giving greater operational flexibility.

The flow channels may be closeable in a wide variety of ways. One preferred method is to introduce a slideably mounted body in the drill string above the exit port of the flow channels. Such a slideably mounted body could be biased to a withdrawn position, allowing fluid to flow out of the exit port. Once sufficient downforce is applied to the slideably mounted body it slides into a mating sleeve and closes off the exit port by physically gating it closed.

BRIEF DESCRIPTION OF THE DRAWINGS

The invention will now be illustrated, with reference to the following figures, in which:—

DESCRIPTION

Figure 1:
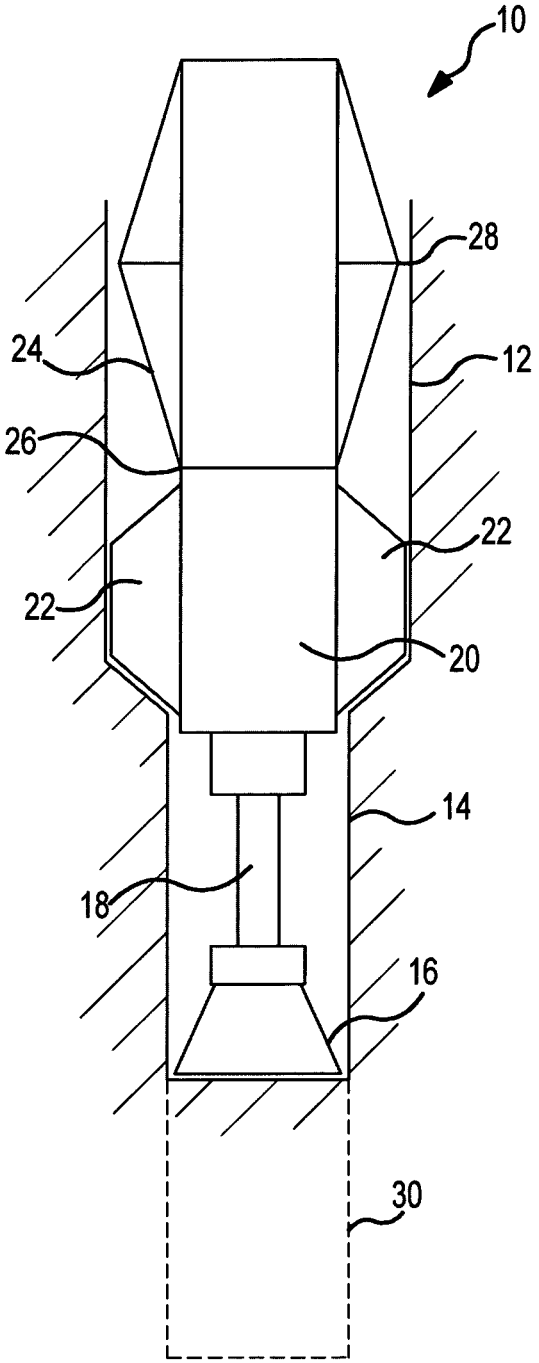
FIGS. 1 to 4 are side views of an apparatus according to the invention carrying out a combined drilling and fracturing operation.

Referring to FIGS. 1 to 4, a sequence of steps in the carrying out of the present invention is shown. FIG. 1 shows a bottom hole apparatus 10 drilling a wellbore 12 initiated by the drilling of pilot hole 14. Apparatus 10 comprises a pilot drill bit 16 connected to a variable length shaft member 18 of diameter less than that of the pilot drill bit 16. Above that is reamer 20 comprising extendable/retractable drilling elements 22. Above that is tubular body portion 24 having a circular cross section the diameter of which increases linearly with respect to height from initial diameter 26 until apex 28, thereafter the diameter decreasing linearly with respect to height.

The diameter of the reamer 20 when elements 22 are fully retracted is less than that of pilot drill 16. When elements 22 are fully extended the diameter of the reamer 20 is greater than that of the pilot drill 16. FIG. 1 shows elements 22 fully extended expanding the diameter of pilot hole 14 to that of the wellbore 12.

Body portion 24 has a lower diameter 26 less than that of the pilot drill and upper diameter 28 greater than that of the pilot drill.

Also shown is the portion of the pilot hole yet to be drilled 30 in the subsequent figures.

Figure 2:
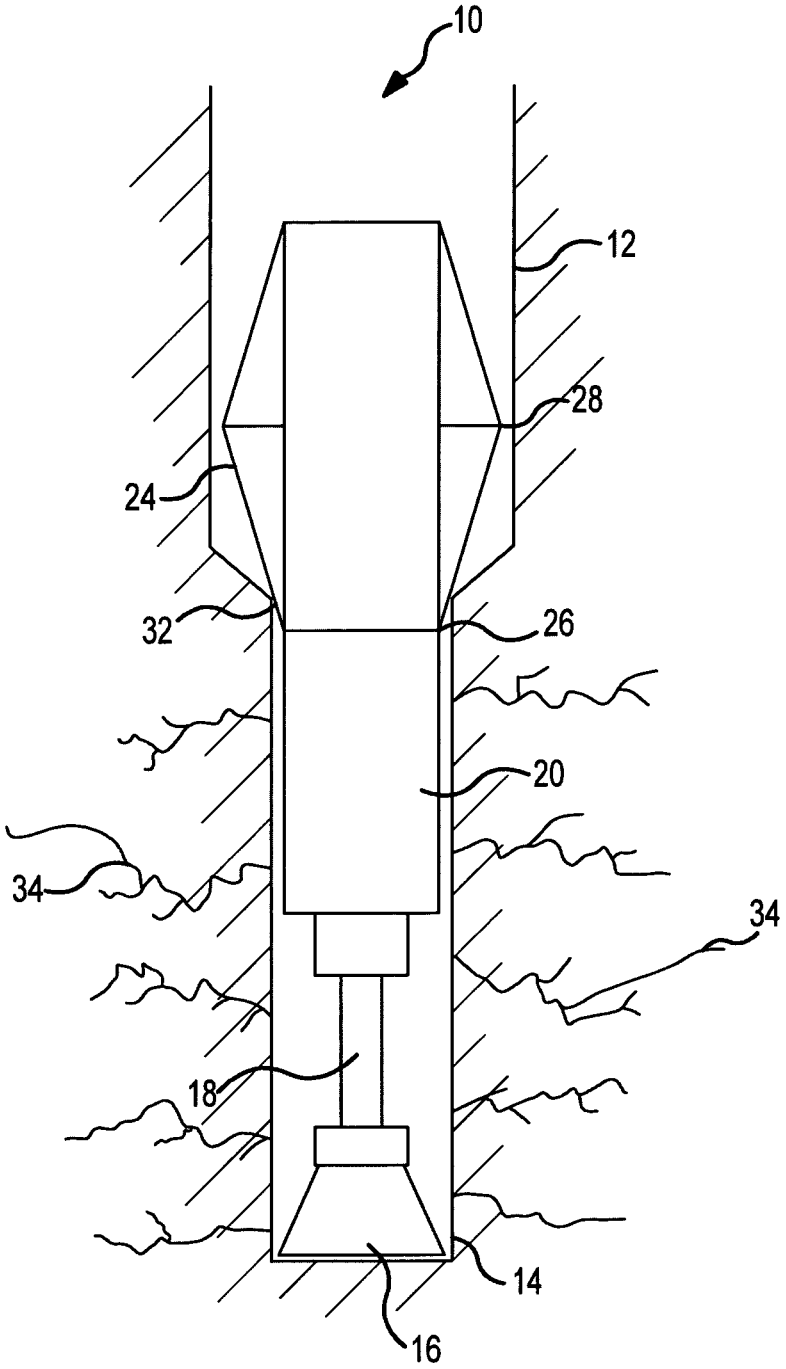

From the position shown in FIG. 1 the elements 22 are fully retracted and drilling continues in the pilot hole 14 only until body portion 24 approaches the top of pilot hole 32 and the apparatus 10 has the position shown in FIG. 2. As can be seen in FIG. 2, as the second diameter of the reamer 20 is less than that of the pilot drill, the reamer passes into the pilot hole 14. As the lower diameter 26 of the body portion 24 is less than that of the pilot hole then that too passes into the pilot hole 14.

As the upper diameter 28 is greater than that of the pilot hole 14 then the body portion blocks the top of the pilot hole 32.

A short distance before hydraulically sealing the pilot hole, drilling mud will have been flushed out of the pilot hole with fracturing fluid, passing out of the pilot drill 16.

Figure 3:
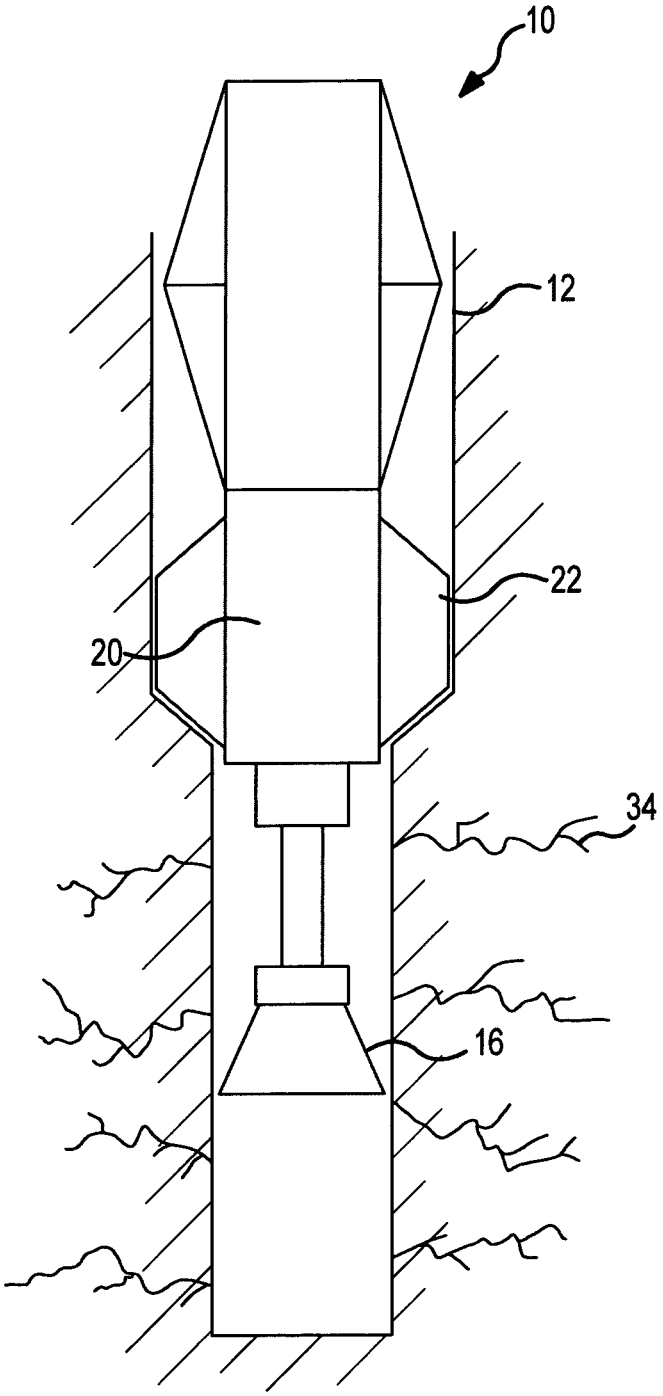
Figure 4:
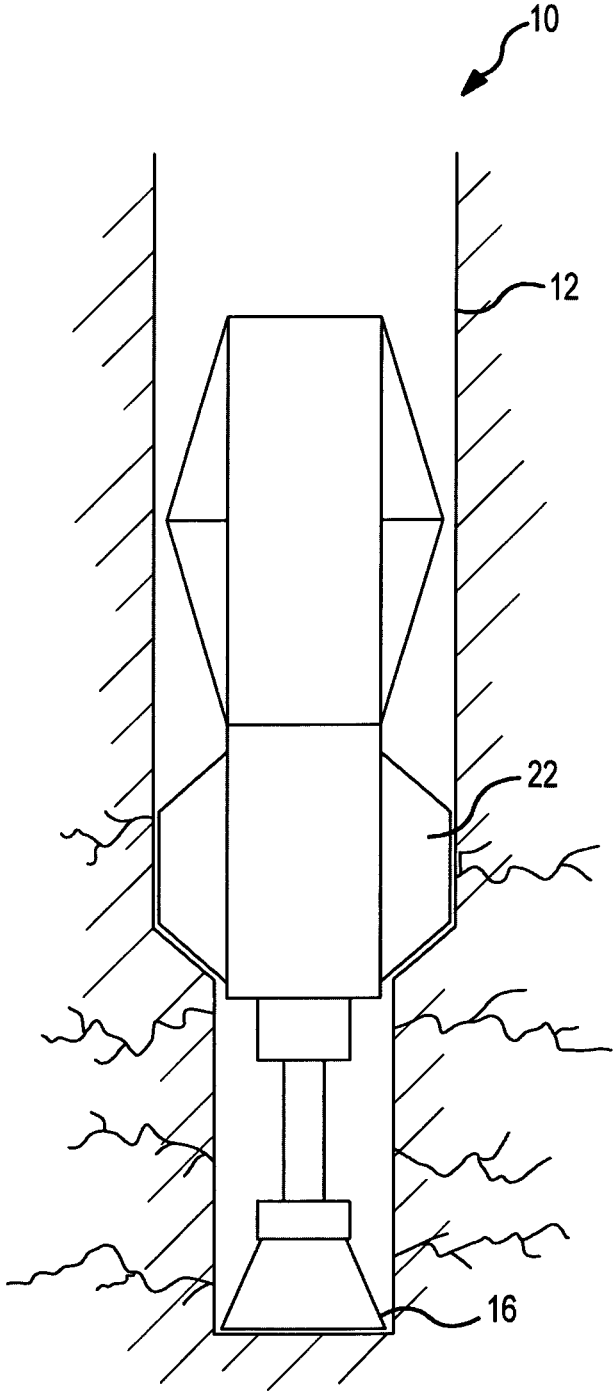

Once sealed, fracturing fluid continues to enter the pilot hole 14 until the pressure rises to such an extent that fractures 34 occur in the walls of the pilot hole 14. These fractures are propped and the apparatus 10 is withdrawn until reamer 20 is free of the pilot hole 14, at which point elements 22 are fully extended and the apparatus is in the position as shown in FIG. 3.

Drilling mud is then pumped again through pilot drill 16 and drilling commences, initially only with reamer 20 expanding the pilot hole 14 to the size of the wellbore 12 as the pilot drill is raised above the bottom. Drilling continues until apparatus reaches the point where pilot drill 16 reaches the floor whereupon the procedure can be repeated from the position shown in FIG. 1 or further drilling, can continue before the above procedure is repeated.

Figure 5:
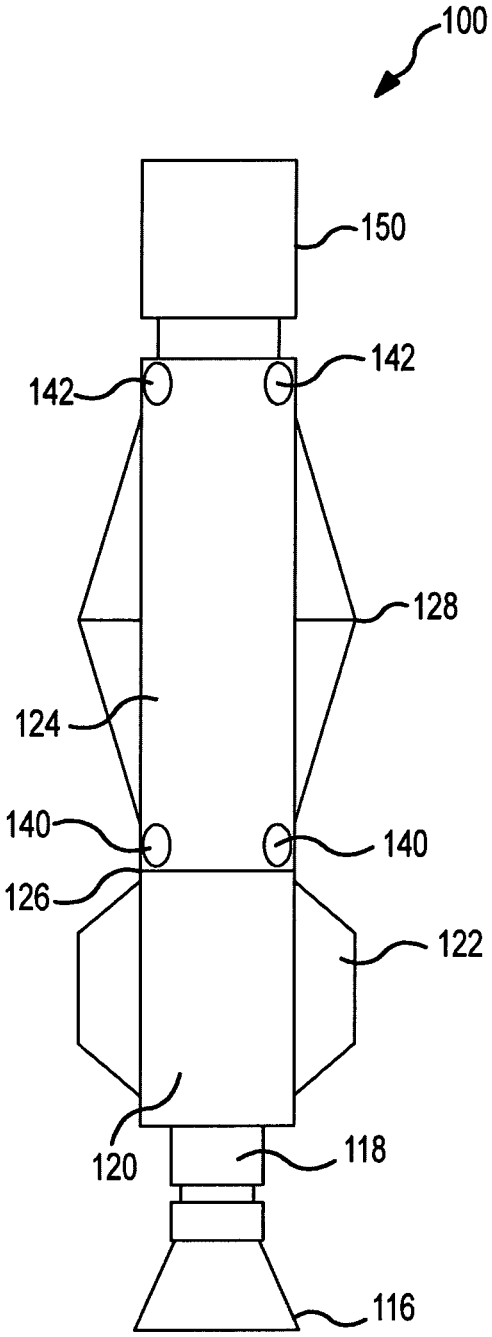
FIG. 5 shows a side view of a second apparatus according to the invention.

FIG. 5 shows an alternative embodiment to that shown in FIGS. 1 to 4 and features which are the same or analogous carry the same number but increased by 100. FIG. 5 shows an apparatus 100 having broadly the same arrangement as shown in FIGS. 1 to 4.

Apparatus 100 differs in that it comprises flow channels having inlet ports 140 and outlet ports 142. Additionally the apparatus 100 has a slideably mounted body 150 which is biased to the withdrawn position shown in FIG. 5, leaving outlet ports 142 open.

In use, once body portion 124 contacts and hydraulically seals the pilot hole, flow channel entry ports 140 are positioned in the sealed pilot hole, allowing fluid to flow out of the pilot hole and preventing too great an increase in fluid pressure.

As before, drilling mud will then stop being pumped and instead fracturing fluid will enter the pilot hole until the drilling mud has been flushed out. Then, additional force is applied to the apparatus until slideably mounted body 150 is forced downwards to slide into the body portion 124 and thereby close off exit ports 142.

With exit ports 142 closed, the pressure of fracturing fluid in the pilot hole increases until fracturing occurs.

The invention claimed is:

1. An apparatus for drilling a wellbore and fracturing the wellbore during the drilling process, comprising:

a lowermost pilot drill bit having a diameter less than a diameter of the wellbore drilled by the apparatus;

a reamer coupled with the lowermost pilot drill such that in use the reamer is disposed above the lowermost pilot drill in the wellbore, the reamer having an adjustable drill diameter from a first diameter less than that of the lowermost pilot drill to a second diameter greater than that of the lowermost pilot drill;

a body portion coupled with the reamer such that in use the body portion is disposed above the reamer in the wellbore, the body portion having a lower diameter less than that of the pilot drill and an upper diameter greater than that of the pilot drill but less than the second diameter of the reamer; and at least one closeable flow channel passing through the body portion and configured to allow fluid to flow up the wellbore through the at least one closeable flow channel when the at least one closeable flow channel is open, wherein the at least one closeable flow channel is configured to close when a force is applied to the body portion to provide for the body portion sealing a top of a pilot hole drilled by the lowermost pilot drill.

2. A method of drilling and fracturing a wellbore employing an apparatus according to claim 1, the method comprising:

using the pilot drill to drill the pilot hole having a pilot hole diameter;

using the reamer in a second diameter position to ream the pilot hole and increase the pilot hole diameter to the second diameter;

retracting the reamer to the first diameter;

continuing to drill the pilot hole;

using the body portion to hydraulically seal the pilot hole by virtue of its variable diameter, wherein the at least one closeable flow channel is closed to provide for the hydraulic sealing;

passing fracturing fluid into the pilot hole sufficient to cause fracture of walls of the pilot hole;

withdrawing the apparatus from the wellbore until the reamer is above the pilot hole; and extending the reamer to its second diameter position and resuming drilling.

3. A method according to claim 2, wherein drilling mud is passed down through the apparatus, out at the drill bit, and then upwards outside the apparatus.

4. A method according to claim 3, wherein the drilling mud is stopped before the fracturing fluid is passed down through the apparatus and into the drilled formation.

5. A method according to claim 2, further comprising:

closing the at least one closeable flow channel when the body portion hydraulically seals the pilot hole.

6. An apparatus according to claim 1, wherein the pilot drill is connected to the body portion via the reamer and a shaft member having a diameter less than that of the pilot drill.

7. An apparatus according to claim 6, wherein the shaft member has a variable length.

8. An apparatus according to claim 1, wherein the body portion is tubular.

9. An apparatus according to claim 8, wherein the diameter of the body portion increases gradually with respect to height.

10. An apparatus according to claim 1, wherein the body portion has a diameter above the upper diameter which is less than the upper diameter.

11. An apparatus according to claim 1, wherein the reamer comprises retractable drilling elements.

12. An apparatus according to claim 1, wherein the at least one closeable flow channel closed by a slideably mounted body disposed above the body portion, wherein in use weight on the slideably mounted body when the body portion seals the pilot hole moves the slideably mounted body relative to the body portion.

13. An apparatus according to claim 1, wherein the pilot drill is connected to the body portion via the reamer and a shaft member having a diameter less than that of the pilot drill.

14. An apparatus according to claim 13, wherein the shaft member has a variable length.

15. An apparatus according to claim 1, wherein the body portion is tubular.

16. An apparatus according to claim 1, wherein the diameter of the body portion increases gradually with respect to height.

17. A method of fracturing while drilling with a bottomhole assembly attached to a drillstring in a wellbore, the method comprising:

drilling a pilot hole having a first diameter;

reaming the pilot hole to produce a wellbore having a second diameter;

retracting the reamer, wherein a diameter of the retracted reamer is less than the first diameter;

drilling the pilot hole with the reamer in the retracted position to provide that the reamer enters the pilot hole;

using a sealing body disposed above the reamer on the bottomhole assembly and having a lower diameter smaller than the first diameter and an upper diameter greater than the first diameter but less than the second diameter to seal the pilot hole, wherein the sealing body comprises closeable flow channels to let fluid flow through the sealing body that are configured to close when the sealing body seals the pilot hole; and pumping fracturing fluid into the pilot hole with the reamer therein to fracture a formation surrounding the pilot hole.

18. The method of claim 17, further comprising:

flowing drilling fluid out of the pilot hole through the closeable flow channels when the fracturing fluid is pumped into the pilot hole.

* * * * *